US011583147B2

(12) United States Patent
Roff

(10) Patent No.: US 11,583,147 B2
(45) Date of Patent: Feb. 21, 2023

(54) ADVANCED HYGIENIC EXCRETA SYSTEM

(71) Applicant: Think and Ink Enterprises, Inc., Dillon, SC (US)

(72) Inventor: Roger R. Roff, Dillon, SC (US)

(73) Assignee: Think and Ink Enterprises, Inc., Dillon, SC (US)

( * ) Notice: Subject to any disclaimer, the term of this patent is extended or adjusted under 35 U.S.C. 154(b) by 0 days.

(21) Appl. No.: 17/374,470

(22) Filed: Jul. 13, 2021

(65) Prior Publication Data

US 2021/0338022 A1 Nov. 4, 2021

Related U.S. Application Data

(63) Continuation-in-part of application No. 16/521,554, filed on Jul. 24, 2019, now Pat. No. 11,089,923.

(60) Provisional application No. 62/702,625, filed on Jul. 24, 2018.

(51) Int. Cl.
*A47K 13/10* (2006.01)
*A47K 17/02* (2006.01)

(52) U.S. Cl.
CPC ..... *A47K 13/10* (2013.01); *A47K 17/026* (2013.01); *A47K 17/028* (2013.01)

(58) Field of Classification Search
CPC ..... A47K 13/10
USPC ..... 4/254, 185; 297/391, 411.2, 423.1
See application file for complete search history.

(56) References Cited

U.S. PATENT DOCUMENTS

| | | | | |
|---|---|---|---|---|
| 7,039,964 | B2 * | 5/2006 | Cavanagh | A61G 7/1007 4/246.1 |
| 7,051,383 | B1 * | 5/2006 | Paz | A61G 7/1088 4/408 |
| 8,272,081 | B2 * | 9/2012 | Anderson, Jr. | A61G 5/14 4/667 |
| 2006/0087097 | A1 * | 4/2006 | Kramer | B66B 9/0807 224/407 |
| 2007/0209111 | A1 * | 9/2007 | Boger | A61G 7/1098 4/667 |
| 2008/0038107 | A1 * | 2/2008 | Henshaw | A61G 7/1007 4/667 |
| 2015/0113719 | A1 * | 4/2015 | Good | A47K 17/028 4/254 |
| 2020/0029755 | A1 * | 1/2020 | Roff | A47K 13/10 |

* cited by examiner

*Primary Examiner* — Lori L Baker
(74) *Attorney, Agent, or Firm* — Kim and Lahey Law Firm, LLC; Douglas W. Kim; Seann P. Lahey

(57) ABSTRACT

An accessory for an advanced hygienic excreta system comprising a base disposed around a bowl having a retracted position and an operational position; a seat having a convex surface configured to position a user's rectum below a user's knees when a user is seated on the seat and the seat is in a seated position; a footrest assembly having a footrest wherein the footrest is configured to be received into the base and to extend away from the base to support feet and legs of the user when the user is in a seated position; and, a controller carried by the base and connected to a motor set connected to the seat, footrest assembly and arm rest assembly and configured to receive input from an input device and actuate the motor set to extend and retract the seat, footrest, and arm rest.

18 Claims, 13 Drawing Sheets

ADVANCED HYGIENIC EXCRETA SYSTEM

This application is a continuation in part of U.S. application Ser. No. 16/521,554 filed Jul. 24, 2019 which claim priority on U.S. Provisional Patent Application 62/702,625 filed Jul. 24, 2018.

BACKGROUND OF THE INVENTION

1) Field of the Invention

The present invention relates to improved toilet seat adaptation for elevation of the feet and knees, rotation of the pelvis to raise the genitals above the rectum, and handle support for using the abdominal muscles.

2) Description of Related Art

The present invention is directed to a toilet seat adaption or accessory directed to facilitate a healthier, perhaps life-saving, and improved method of performing a bowel movement along with a systematic process of hygienic cleansing that promotes better health while reducing complications that arise from using the current rendition of the Western toilet. Typically, the Western toilet seat is a hinged unit consisting of a round or oval open seat, and usually a lid, which is bolted onto the bowl of a toilet used in a sitting position. The seat can be either for a flush toilet or a dry toilet. A toilet seat consists of the seat itself, which may be contoured for the user to sit on, and the lid, which covers the toilet when it is not in use. Further, many religions and cultural customs require individuals to squat to eliminate waste from their bodies and cleanse the waste by rinsing the area with water while flicking the residual debris away with the fingers of the left hand. The elder citizens and physically compromised in these societies have a very difficult time abiding by the squatting and cleaning rules, especially when the only available facilities are Western toilets.

The toilet seat can come in a variety of heights. There is a "comfort height" or "right height" seat which features bowls that are 17 to 19 inches high. The standard toilet seat is about 15 inches high. It has been shown that higher bowl height can be good for the knees and back and can offer real advantages to taller folks, the elderly and people with mobility problems. When individuals are disabled because of age related physical impairments such as injuries, arthritic conditions, muscular and neurological compromises; basic functions, including hygiene, and even basic health care become more difficult. For example, the medical profession does not recommend colonoscopy after the age of 75 for fear of rupturing the intestinal lining.

Further, there are certain physical attributes where the Western toilet seat is not conducive to such health activities. For example, the Valsalva Maneuver is any attempt to exhale with the mouth and nose closed. The maneuver is commonly used when straining to have a bowel movement. It is difficult to evacuate properly on a sitting toilet because the colon is not supported and pressurized. There is also a kink at the rectum and anus which obstructs the flow of waste. During a Valsalva Maneuver, with the holding of the breath and straining, the diaphragm is forced downwards by the increased pressure inside the thoracic cavity. The Valsalva Maneuver can be dangerous for several reasons. The increased pressure in the thoracic cavity reduces the amount of blood flowing into the thoracic cavity, especially in the veins leading to the right atrium of the heart. The maneuver can also cause blood clots to detach, bleeding, irregular heart rhythms, and cardiac arrest. Further, heart attacks and other health issues have been linked to the Valsalva Maneuver, which in turn, is closely associated with toilets.

There is a need for a system that can avoid the physiological problems that are associated with the use of the Valsalva Maneuver during a bowel movement. Empirical data shows that our aging population and people with comprised circulatory systems are placing themselves at risk for moderate to severe complications and even death.

Further, conventional toilet seats are not well suited for elderly and disabled persons. They are not able to accommodate perineal cleaning by the elderly or disabled user, especially those having spinal cord and/or muscular skeleton injuries that limit or prevent full range of motion of legs. U.S. Pat. No. 4,882,791 discloses a toilet bowl that is formed with recesses along the top margins of its side walls to permit hand insertion for carrying out perineal cleaning functions. The combined height of the toilet bowl and seat in conjunction with optional handrails serve to promote user transfer from a wheelchair. However, this invention makes no mention of supporting the legs.

Further, the water sources from a bidet hold the prospect of contaminating the vagina and urethra due to the misdirected water source forcing the cleansing water from the anal area forward and directly into the vagina and urethra, which holds the prospect of contaminating these critical health areas with micro-organisms consisting of bacteria, viruses, etc. Fecal materials are a major cause of vaginal and urethral infections. Fecal material contains over one hundred viral pathogens, over one hundred bacterial pathogens, over one hundred protozoan cyst and helminth eggs so that consequently exposing the hand to fecal material increases the risk of many diseases including: flus, colds, bronchitis, sinusitis, ear ache, intestinal disorders such as diarrhea issues, typhoid fever, skin conditions, rashes, hepatitis, giardiasis, cryptosporidiosis and shigellosis, fecal streptococci (attributed to the source of bacterial pneumonia, bacterial meningitis and ear infections), and the like.

Further, human body structure is evolving, but Western toilets have not substantially changed in shape for hundreds of years. However, buttocks have enlarged substantially in the last fifty years. Millions of individuals in the United States have reported that they cannot sufficiently reach operative body parts for cleaning due to the size increase of their own bodies and the size for toilet seats. Further, body weight has increased over 30 pounds on average than just 60 years ago. Increased weight substantially reduces flexibility, restricting individuals' abilities to properly clean. Arm lengths have increased preventing the hand from reaching the anus. Hips are spreading and becoming less flexible so that individuals have a harder time supporting a squatting position. Spines have drastically changed in most people due to age, arthritis and loss of flexibility; consequently, the body cannot rotate sufficiently for the hand to reach the anus for cleaning or treating purposes. The knees have become weakened due to age, injury, arthritis and weight gain which makes it difficult and potentially impossible to squat. The ankles with age, injury and arthritic conditions will not tolerate any stressful weight or flexibility which prevents squatting. To accept these growing problems with lifestyle, the United States Census Bureau certifies that over 37 million Americans aged 15 and over have difficulty performing one or more physical activities that were defined as activities that limited walking, and physical activities. Women have higher overall disabilities than men. 36 million people have arthritis in the United States. 65% to 75% of all Americans will become disabled simply by living to their full life expectancy.

Accordingly, it is an object of the present invention to provide for a seat or accessory that can elevate the feet and knees.

Accordingly, it is an object of the present invention to provide for a seat or accessory that can rotate the pelvis to raise the genitals above the rectum.

Accordingly, it is an object of the present invention to provide for a toilet seat and/or accessory that can include handles for supporting the use of the abdominal muscles.

Accordingly, it is an object of the present invention to provide for a seat or accessory that can reduce or eliminate contact with fecal matter.

SUMMARY OF THE INVENTION

The above objectives are accomplished according to the present invention by providing an accessory for an advanced hygienic excreta system comprising: a frame; a rear handle assembly attached to the frame; a front handle assembly attached to the frame; a seat having a retracted position and a deployed position movable between these two positions with seat handles; a rear cam shaft cooperatively associated with the frame and a seat allowing the seat to move between the two positions; and, a footrest attached to the frame having a retracted position generally flush with the floor and a deployed position for supporting the feet and/or legs of the user.

The advanced hygienic excreta system can include a base disposed around a bowl having a retracted position and an operational position; a seat having a convex surface configured to position a user's rectum below a user's knees when a user is seated on the seat and the seat is in a seated position; a footrest assembly having a footrest wherein the footrest is configured to be received into the base and to extend away from the base to support feet and legs of the user when the user is in a seated position; a footrest cover included in the footrest assembly configured to conceal the footrest when the footrest is received into the base; an arm rest assembly having an arm rest wherein the arm rest is configured to be received into the base and to extend away from the base to support a user's arm when the user is transitioning from a standing position to the seated position; an arm rest cover included in the arm rest assembly configured to conceal the arm rest when the arm rest is received into the base; wherein a rear portion of the seat is configured to extend upwards and forward from the base to assist the user from transitioning from the standing position to the seated position; and, a controller carried by the base and connected to a motor set connected to the seat, footrest assembly and arm rest assembly and configured to receive input from an input device and actuate the motor set to extend and retract the seat, footrest, and arm rest.

The input device can be in wireless communications with the controller. The footrest assembly can include a footrest extension configured to transition the footrest from the retracted position to the operational position. The footrest assembly can include a footrest pivot configured to change an angle of the footrest relative to a horizontal plane. The motor set can be configured to transition the footrest assembly from the retracted position to the operating position. The arm rest cover can be a lateral drawer configured to receive the arm rest and to be received in the base when in the retracted position. The arm rest assembly can include an upper arm rest pivot connected between the arm rest and an arm rest extension and a lower arm rest pivot connected to the arm rest extension and an arm rest anchor carried by the base.

The motor set can be configured to transition the arm rest assembly from the retracted position to the operating position. A rear seat extension can be included and configured to transition the seat from the operational position to an assist position. The motor set can be configured to transition the seat from the operational position to the assist position. A forward seat extension can be included and configured to transition the seat from the operational position to an assist position.

The system can include an arm rest motor subset included in the motor set and cooperative associated with the arm rest assembly to transition the arm rest assembly from the retracted position to the operational position; a footrest motor subset included in the motor set and cooperative associated with the footrest assembly to transition the footrest assembly from the retracted position to the operational position; and, a seat motor subset included in the motor set and cooperative associated with the seat to transition the seat from the operational position to an assist position.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. While the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims.

Likewise, other objects, features, benefits and advantages of the present invention will be apparent from this summary and embodiments described below, and will be readily apparent to those skilled in the art. Such objects, features, benefits and advantages will be apparent from the above, in conjunction with the accompanying examples, data, figures and all reasonable inferences to be drawn therefrom, alone or with consideration of the references incorporated herein.

DETAILED DESCRIPTION OF A PREFERRED EMBODIMENT

Figure 1:
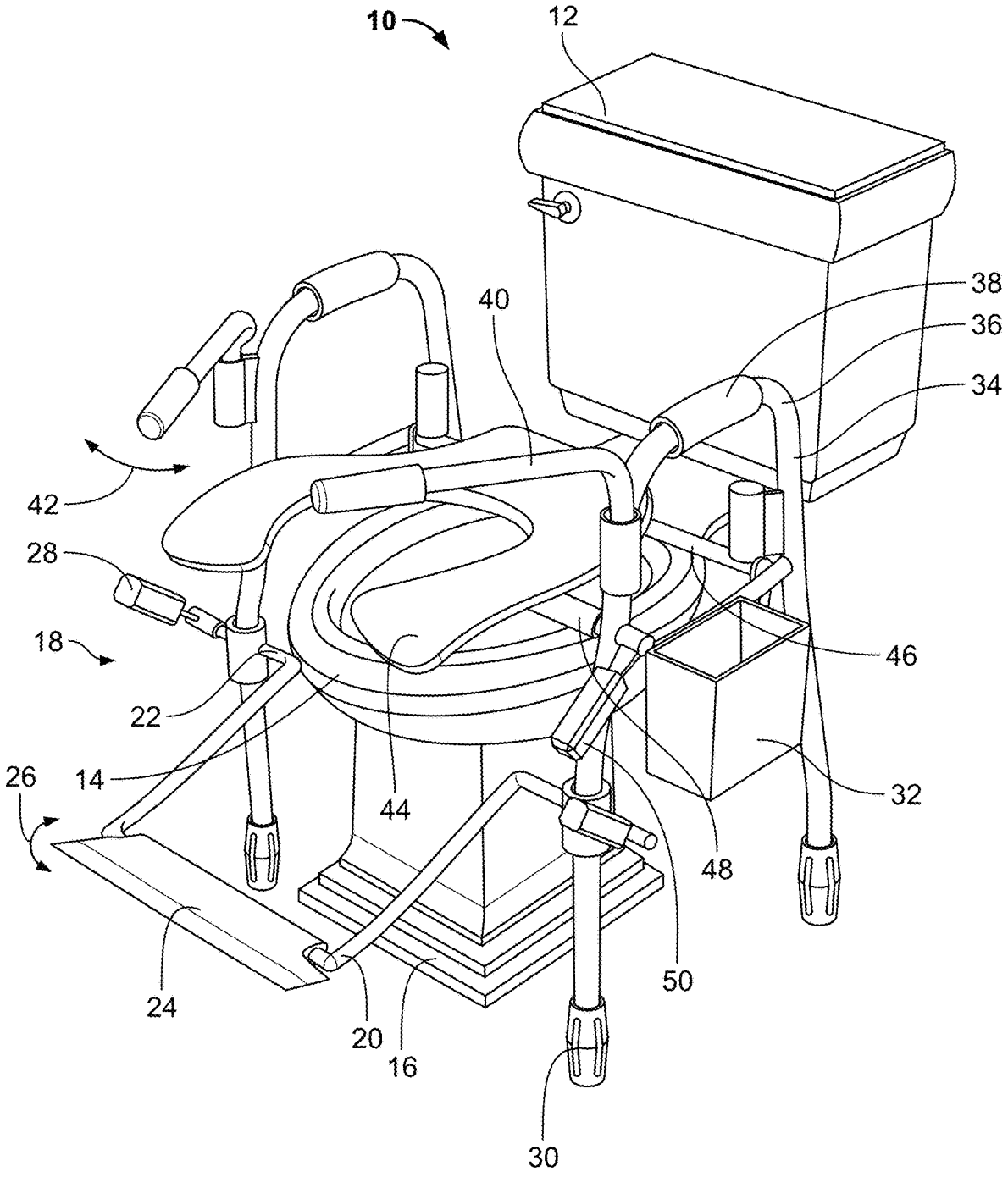
FIG. 1 shows a perspective view of aspects of the system.

With reference to the drawings, the invention will now be described in more detail. Referring to FIG. 1, the conventional toilet 10 with tank 12, bowl 14 and stand 16 is shown. A frame 18 can include lateral leg extensions 20 pivotally connected to the frame at leg pivot 22 allowing the leg extensions to pivot between a retracted position and deployed position. This frame can be configured to fit conventional commodes and in one embodiment, replace the conventional commode seat (which can be removed). The frame can be raised to the level of the commode or the actual commode seat, pushed into place and gently lowered onto the commode seat. Alternative, the conventional seat and lid can be removed allowing the frame to be gently lowered on the commode. The frame can include telescoping members allowing vertical and lateral adjustments in the area occupied by the fame.

In one embodiment, the invention can be portable, and the frame can include wheels allowing the frame to be rolled from one position to another. The arm rests or a side of the frame can be removed or folded out of the way so that a slide board can be used to transition the user from a bed unto the seat. The frame, with seat and user, can be moved from the bed to the commode. Further, defecation can occur where the user desires as the frame is portable. A container can be placed under the seat and the container can be easily removed for cleaning purposes while the user can be easily and quickly returned to bed by use of the slide board.

A footrest 24 carried by the leg extensions for supporting a user's feet and/or legs. The footrest can pivot about the leg extensions generally in direction 26. The leg extension can be locked into position with leg extension lock 28. The leg lock extension can include handles allowing the user to position the footrest at a certain position while remaining seated. The footrest can be automatically or mechanically raised to multiple levels to accommodate different size leg lengths of users. The footrest can be operationally configured, associated and related to the frame so that the knees can be higher than the hips. This configuration provides for an easier, safer and more complete emptying of the bowel by relaxing the tension on the muscle that slings around the rectum from the pubic bone and that same muscle also has an attachment to the coccyx. Further, when the anus is lower than the genitalia, bacterial infection can be reduced or prevented by reducing bacterial contamination of the vagina or urethra. Further, the forward presentation of the genitalia and anus makes both odor and infectious disease producing areas easier to clean and treat. The footrest can be elevated and lowered by several different means including a purely mechanical means that can use a draw lever to raise the footrest into a position and be temporarily locked in that position. In one embodiment, the footrest can be locked in predetermined heights, with three settings in one embodiment. The release of the foot fest can be provided for with a pull of the lever to the side which can slowly return the stool to the floor level. In one embodiment, a motorized assembly can propel the footrest up and down. An electric motor can be included that can also be actuated by a hand crank when power is unavailable or unused.

An electrical, mechanical or hydraulic system can also be used that can be electronically powered and operated to provide the raising and lowering of the footrest. The hydraulic system can also be manually operated, such as with a floor jack, and include a lever until the correct height is reached. The user can also lower the footrest by twisting the handle in one embodiment so that the footrest is returned to a position generally level with the floor.

A cable and motorized spool system can also be used. In this embodiment, the middle of the sitting area can include a support shaft that runs from the middle of the under surface of the sitting area to near the floor where the vertical support shaft is met by a lateral support system. The main vertical support structure can encase a cable that travels over a pulley disposed at the top. The cable can travel over the pulley down to the footrest and pulls the footrest up or allows it to be lowered. Each side can include feet in the footrest that fit into guiding slots that prevent the footrest from twisting. In one embodiment, there can be two cables where one motor could operate a single rotating shaft that rotates two spools, two cables, and two pulleys. The two cables can be attached to the lateral sides of the footrest. Cable guards can be included to protect the cables from coming off a pulley system. A chain can be used in one embodiment.

The frame can include feet 30 that can be non-slip material to prevent the frame from slipping out of position on the toilet seat when in use. A supply box 32 can be attached to the frame.

Rear handle assembly 34 can include a rear arch 36 and an arm rest 38 that can be used to assist the user in entering and exiting the frame. A front handle 40 can be laterally pivotally attached to the frame and pivot in a general direction shown as 42. Two front handles can be included in a front handle assembly that can pivot between a retracted position and a deployed position.

A seat 44 can be supported by a rear cam shaft 46 so that the rear of the seat can move vertically and/or horizontally to assist the user sitting on the seat and exiting the seat. The front of the seat can be supported by a seat extension 48 carried by the frame. In one embodiment the extension is connected to a seat handle 50 so that when the seat handle is rotated downward, the seat moves forward and when the seat handle is rotated upward, the seat moves rearward. The seat handles, seat and rear cam shaft can be cooperatively associated so that when the seat is forward, it is higher than when the seat is moved rearward, in one embodiment.

The seat can include rocking functionality. In this embodiment, as the user's legs rise on the footrest the seat can tilt backward lowering the anus in relation to the genitals. When the footrest returns to the floor, the seat can tilt forward easing the effort of the user to transition off the commode. The seat with rocking functionality, in combination with a pull stick (discussed below) can stimulate peristaltic activity of the intestines and result in a tightening and relaxation of the abdominal muscles in such a way that aids the "milking" or massaging the intestines in an effort to encourage the evacuation of the stool. Further, there is a decrease in the need for pressure to build up in the chest, which requires the filling of the chest with air and then strongly contracting the chest muscles while forcing the diaphragm downward. By decreasing pressure in the chest, serious pressure related health conditions can be reduced so that the risk of permanently compromised health or death of the defecator is reduced. The seating area can be ergonomically designed to reduce pressure type injuries to thigh blood vessels and nerves. Therefore, if a user spends extended time on the commode, the user's legs will remain reasonably fresh. The seat can be concave to assist with proper function of disposal tissue. The seat can also include or be attached to a seat warming assembly to set the seat surface temperature according to the user's desire.

A vibrational section of the seat can be included with a stimulator configured to fit comfortably into the rear of the seat. The stimulator can include a vibrating mechanism that can stimulates and excites the 2nd, 3rd, and 4th, sacral nerves which have a propensity to stimulate rectal peristalsis, the release of the bladder content and the relaxation of the pubococcygei muscle and puborectalis muscle resulting in an easier, quicker, and more complete evacuation of the bowel and bladder.

The frame can also carry a pull stick that can be sheathed in a case between the legs at the front of the seat and can be released mechanically or through an electronic release switch on the control pad. The pull stick allows the user to pull on the pull stick to create a rocking motion of the seat in an effort to work the waste material through the intestinal track. The pull stick can instigate an abdominal rhythmic action creating a proclivity for gentle contractures of the abdominal muscles including the muscles along the intestine responsible for peristalsis activity. This musculature activity can aid in prompting an easy content movement through the intestines and emptying of the bowels.

Figure 2:
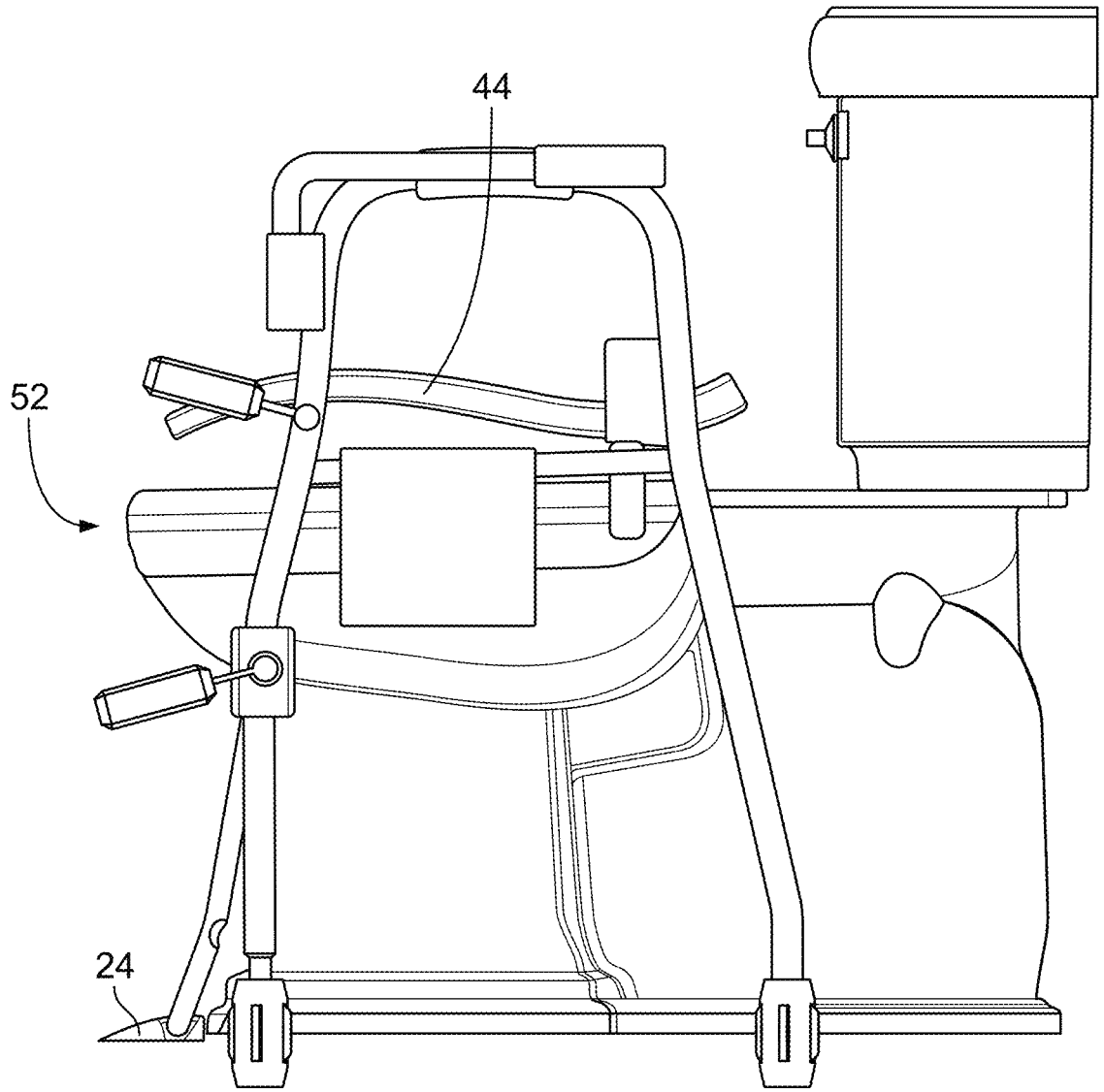
FIG. 2 is a side view of aspects of the system.
Figure 3:
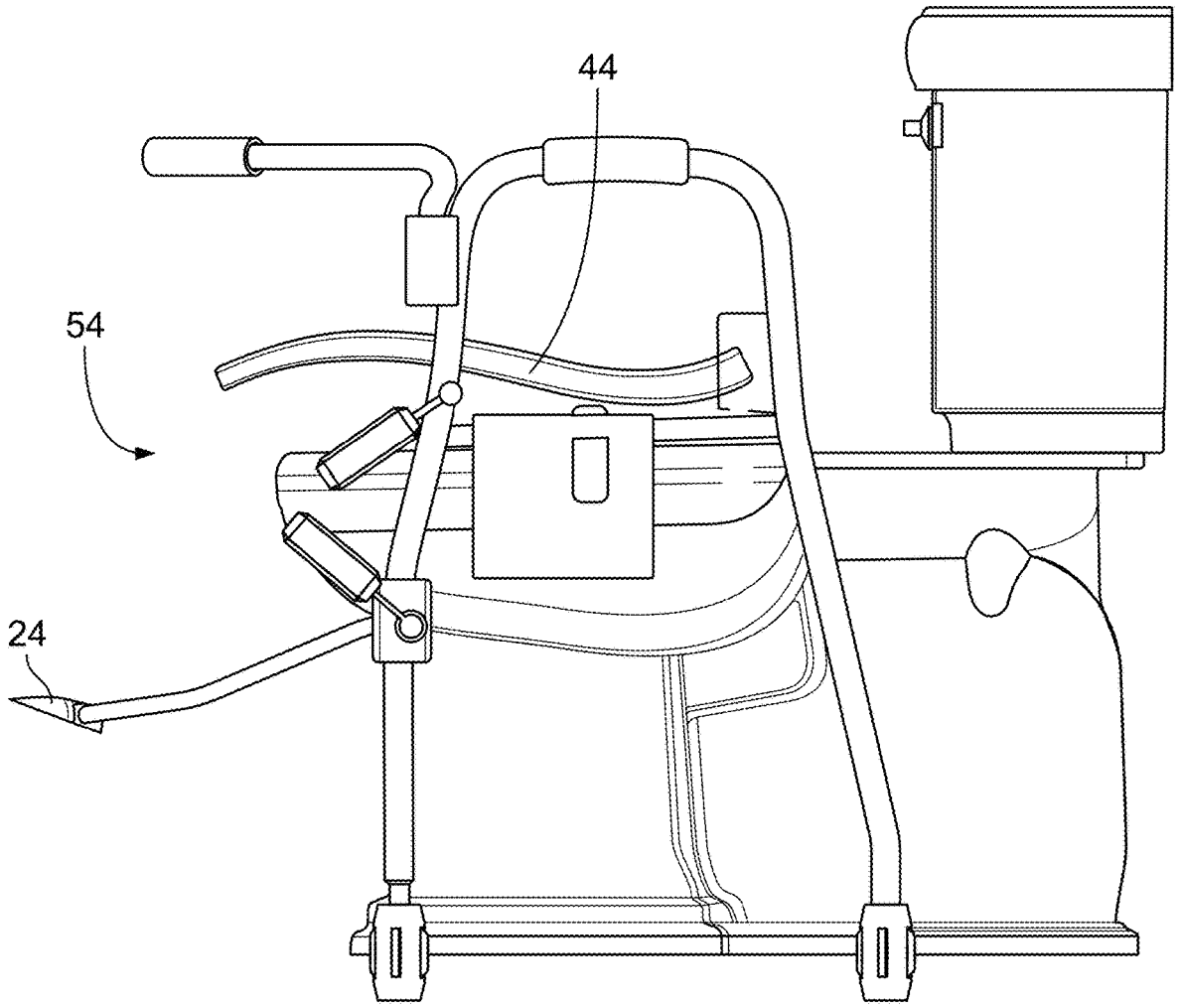
FIG. 3 is a side view of aspects of the system.

Referring to FIG. 2, the invention is shown in a retracted position 52. The seat 44 is disposed rearward. The footrest 24 is lowered and can be flush with the floor. The forward handles are disposed rearward allowing the user to enter the seat. Referring to FIG. 3, the invention is shown in a deployed position 54. The seat 44 is disposed forward. The footrest 24 is raised to support the feet and legs. The forward handles are extending forward allowing the user to enter the seat. The various components of one embodiment of the invention with one embodiment's dimensions are shown in FIG. 4.

Figure 4A:
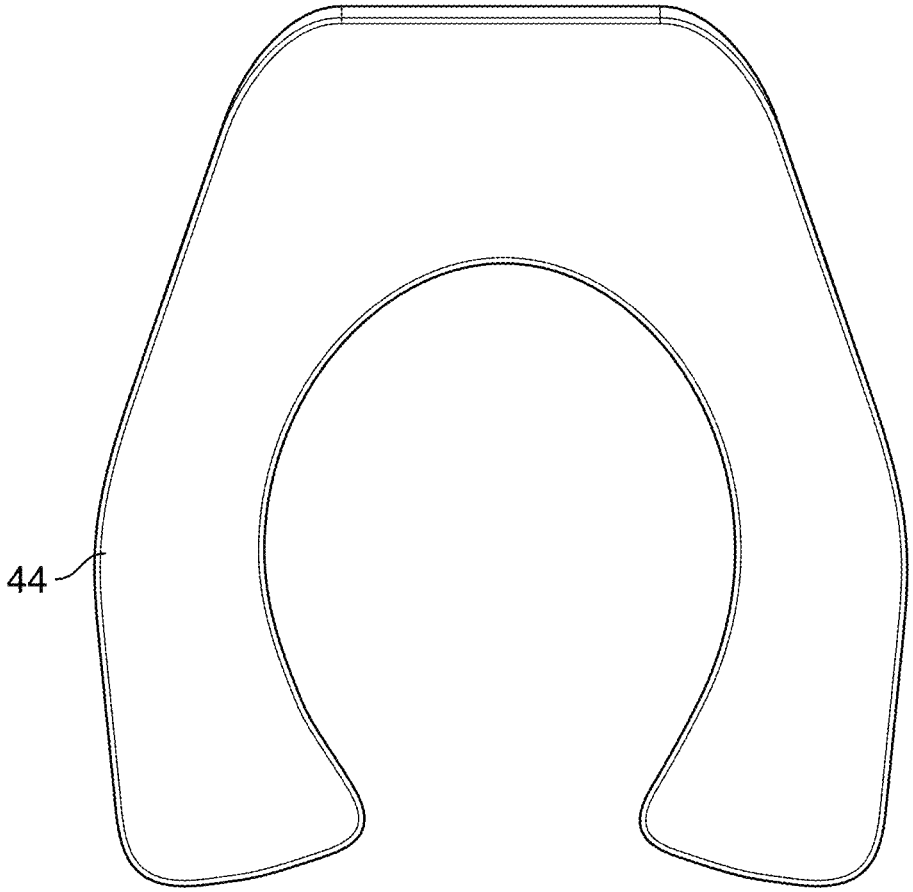
FIG. 4A is a top view of aspects of the system.
Figure 4B:
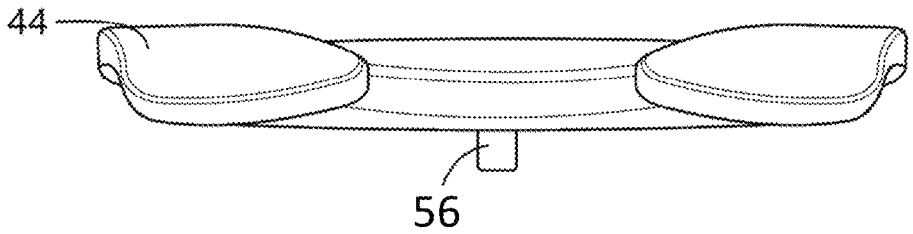
FIG. 4B is a front view of aspects of the system.
Figure 4C:
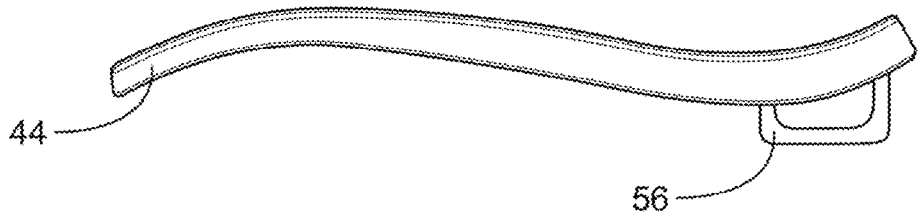
FIG. 4C is a side view of aspects of the system.

Referring to FIG. 4, the seat 44 can include a cam connection 56 for receiving the rear cam shaft. The seat can include a general "S" cross section lengthwise to provide for a determined tilt forward for the user which lowers the rectum below the genitals which can reduce the risk of urinary tract infections. In one embodiment the tilt is about 12°. In one embodiment the tilt is between 10° and 14°. In one embodiment, the tilt is 15° or less.

In one embodiment, the invention, in the deployed position, has a length of about 75 cm front to back, height from the floor to the top of the handles of about 70 cm, a footrest that is about 22 cm above the ground, handles that are about 26 cm above the top of the bowl of the toilet, width of about 72 cm, height from the floor to the extensions of about 28 cm, and height of the floor to the seat handles of about 51 cm. When the invention is deployed, the width can be about 113 cm as the front handles rotate outward.

In one embodiment, there can be an adjustable stool height which can also allow for raising and lowering the legs. The seat can be a saddle type commode seat and include a vibrational sacral pad and an abdominal vibrational stimulator. The seat can include an arm rest and security bar to prevent accidentally falling off the invention. The seat can include pads that are sanitized and included in a sanitization system including a carrier for the pads, cleansing paper pads, drying pads, drying wand, pressurized water delivery system, heated water for cleaning, medicated pads or other pads with physical properties including impregnated with medicines, lubricates and the like. The seat can also carry an accu-pressure perineal stimulator, have an odor suppressor, and audio and/or visual warning for emergency indicator actuated buy the user. The system can be powered by a local power source such as a battery or external power source such as AC outlet.

The seat can include a heating element with temperature control and cut off safety features to prevent overheating and electrical shorts. An illumination assembly can be included that can be used to illuminate the bowl or water in the bowl. The illumination assembly can be one or more colors and can be actuated by sound, light or directly from a remote controller.

Audible alerts can be included with a controller (master control system) that can be attached to various sensors so that when a sensor detects abnormal conditions, the audible alarm can be actuated. A warning assembly can be included to provide audible or visual alerts that the user is in a troubled state. The warning assembly can be initiated by the user, when the user attempts to leave the commode prior to a certain event such as when the care taker requires a certain period of time, by the release of pressure on a pressure seat, proximity sensor, change in ambient light, or the like. The care giver or other individual can be alerted by the audible or visual indicator at or near the frame or by a remote device.

The master control system can be a computing device removably installed on right or left arm rest or otherwise carried by the frame. The master control system can operate the footrest, pull stick release, vibrational seat or belt, sacral nerve vibrational stimulator, temperature of the commode seat, temperature of the cleaning water and also serve as an audible or visual indicator and a system that can be used by the user to request assistance.

The invention is configured to be disposed over contemporary residential and commercial toilets/commodes. The seat and frame can be configured to have various positions allowing the user to transition from a generally standing position to a seated position.

In one embodiment, there can be two arm rests, one on the right and one on the left. These two arm rests can help define a safety corral. The arm rest can be included in the frame and can serve several functions including aiding a person getting on the commode seat, assisting a person getting off the commode seat, securing the body, acting as a resting place for the arms while relaxing in preparation for a bowel evacuation, protecting a person from falling from the commode in the event of the user experiencing a weak or dizzy spell, passing out or some other unforeseeable event. The framework of the arm rests can contribute to the support of a manual lever that attaches to and raises the footrest to a desired height, provide for the secure attachment of the pull stick, a vibratory belt, and the seat.

The safety corral can include a security bar located in front of the user that fits between the two arm rests which reduces the risk of the user falling. Users who suffer with severe irritable bowel syndrome or inflammatory bowel disease often, after and/or during the bowel evacuation process, have conscious washout periods where they feel weak and unstable. User's with advanced Parkinson's, Alzheimer's, ALS and other debilitating conditions require protective measures to guard against injuries from falls, including those off the commode.

The invention can include a security belt that can assist in securing a user to the seat and can reduce the risk of falls due to lack of stability or momentarily blacking or passing out. The belt can include a vibration assembly that can be set to treat specific tight areas of the abdomen, which may encourage the movement of the bowel in certain sections of the intestines. The belt can include a mechanism that may aid in the stimulation of intestinal peristalsis, wherever the intestinal flow is stagnated, the positioning of the vibrating action can be placed. This unique system aids in relieving intestinal discomfort, the dangers of constipation and speeds up the process of a bowel evacuation.

The invention can also include a sanitizing cabinet that can be carried by the frame and can be on the right or left side depending on the side that is most convenient for the user. The sanitizing cabinet can be in a "saddle bag" like cabinet configuration carried by the frame. The sanitizing cabinet can contain several elements including: a pressurized canister of fluid such as water that can be heated to a desired temperature by a heating element included in the sanitizing element; tubing that can be attached to the pressurized canister on one end; a nozzle or wand with hand grip, on and off switch, tension rod for opening and closing handle jaws in one embodiment wherein the jaws can have rubberized projections to improve grip; projections included in the nozzle that can be operatively associated with holes configured to facilitate cleansing, drying or medicating pads; pad release allowing the release of used pre-punched paper pads wherein the wand can be reloaded with pads.

Benefits of the sanitizing container and elements can be used as a spray to break loose most of the fecal residue and particles from the anus and the surrounding anal crevice. The wand can be loaded with the mildly imbued non-allergic soap pad that can aid in cleaning the area by assisting in removing the oil based fecal residue, which plain water or dry pads could not do. A mildly non-allergic soap pad can be used and can then be released into the commode and the wand can be used to rinse/flush out any remaining loosened fecal materials and to flush the area of any remaining soap or excreta residue. The anal crevice can be dried either by selecting the forced warm air drier or attach a clean non-soaped, non-medicated dry pad to the wand and dry the entire anal crevice. Medicated pads can be used to treat a variety of conditions and can assist with soothing and assisting in the healing of the anal crevice. The medicated pad can be used to wipe the area most adversely affected and when finished, discarded in the commode.

The wand could allow the user to shoot water when cleaning, rinsing or flushing the genital and anal areas from the front to the back which is unlike a 'bidet' that either shoots water from the back towards the front or bubbles up from directly under the anus and genital area. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

The invention can include a dehydrationizer/evaporationalizer that can be in a "saddle bag" like dehydrationizer/evaporationalizer cabinet configuration carried by the frame. The dehydrationizer/evaporationalizer cabinet can conveniently be placed on either side of the frame. The dehydrationizer/evaporationalizer cabinet can include a small blower system attached to a flexible hose that can include a drying nozzle. The dryer mechanism can include a safeguard to limit the temperature of the air being used for drying to reduce or avoid injuries. The dehydrationizer/evaporationalizer cabinet can include a pouch or other holder for odor reducers or neutralizers such as chemical or natural substances in liquid, solid or aerosol form.

In one embodiment, the seat can be manually, physically or hydraulically operated. The seat can contact the butt generally at a 75° and slowly lower the user down to a 45° angle of the seat. The seat can reverse this transition and return the user to a generally standing position. When the user first stands on the foot platform, the security belt can be actuated and secure the user to the seat in an effort to prevent falls. Such functionality is beneficial when the user is unable to sit or raise due to loss of knee and hip strength. When the user backs into the seat to be semi-seated, the user can fasten a retractable safety belt in place which secures the user and protects from any accidental fall as the seat is being lowered or raised. When the user finishes, the seat can be raised and the user is returned to a generally standing position, unfastens the security belt and walks or is otherwise moved away. The seat can also include a warmer.

The invention can reduce the pressure required to have a successful bowel movement by as much as three (3) times reducing or preventing self-injury such as hemorrhoids, vascular rupture, Diverticular diseases, fissures, and organ prolapse. Further advantages include the ability of the system to be used by disabled individuals who are pleasantly and safely aided in their effort to experience a successful bowel movement. Further, a large part of the population takes opioids and other pain type relievers to endure their physical compromises and pain, unfortunately those pain relievers cause lazy and slow peristaltic action of the intestine resulting in a condition called constipation. The invention includes intestinal stimulating methods that facilitate intestinal activity and an easier and quicker bowel evacuation, including the sacral vibrations and abdominal vibrations. The pull stick and the fact that the anus is positioned lower than the hips relaxes the pubo-rectal muscle that has a tendency to strangle the rectum in the seated position of the typical Western commode.

Figure 5:
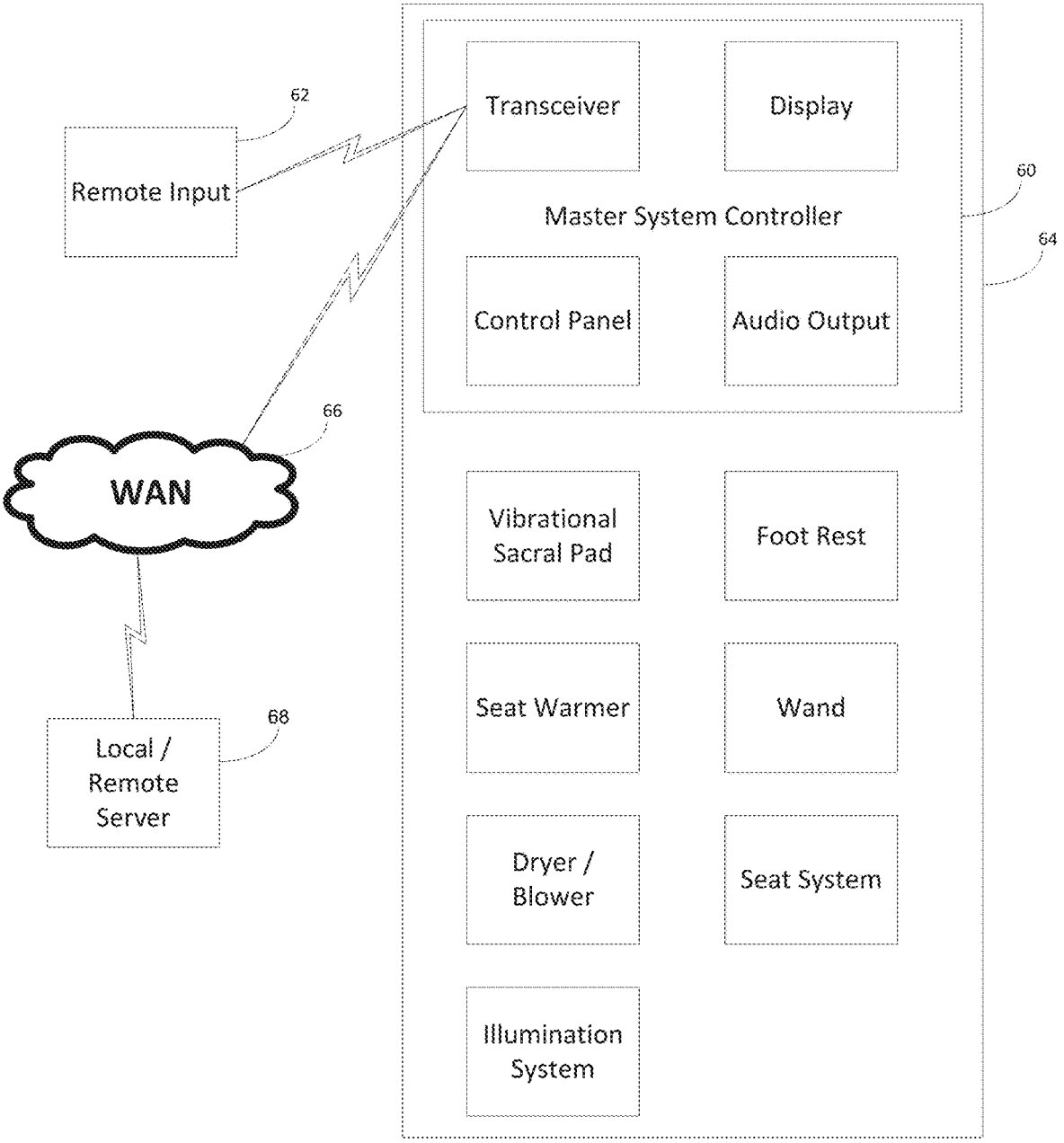
FIG. 5 is a schematic of the system.

Referring to FIG. 5, the master controller 60 can include the transceiver for communications with a remote computing device 62 (e.g. pad, laptop, desktop, local server, central server, watch and the like), display, control panel for providing input and audio output. The master controller can be connected to one or more components shown in one embodiment, partially or completely enclosed in housing 64. The master controller system can also be connected to a wide area network 66 and local or remote server 68. The master controller can receive information from the attached components and transmit information to or from the components, including actuating the components, and store information for future study or record keeping on a local computer, local server or remote server. Information can also be communicated between a remote device and the master controller.

Figure 6:
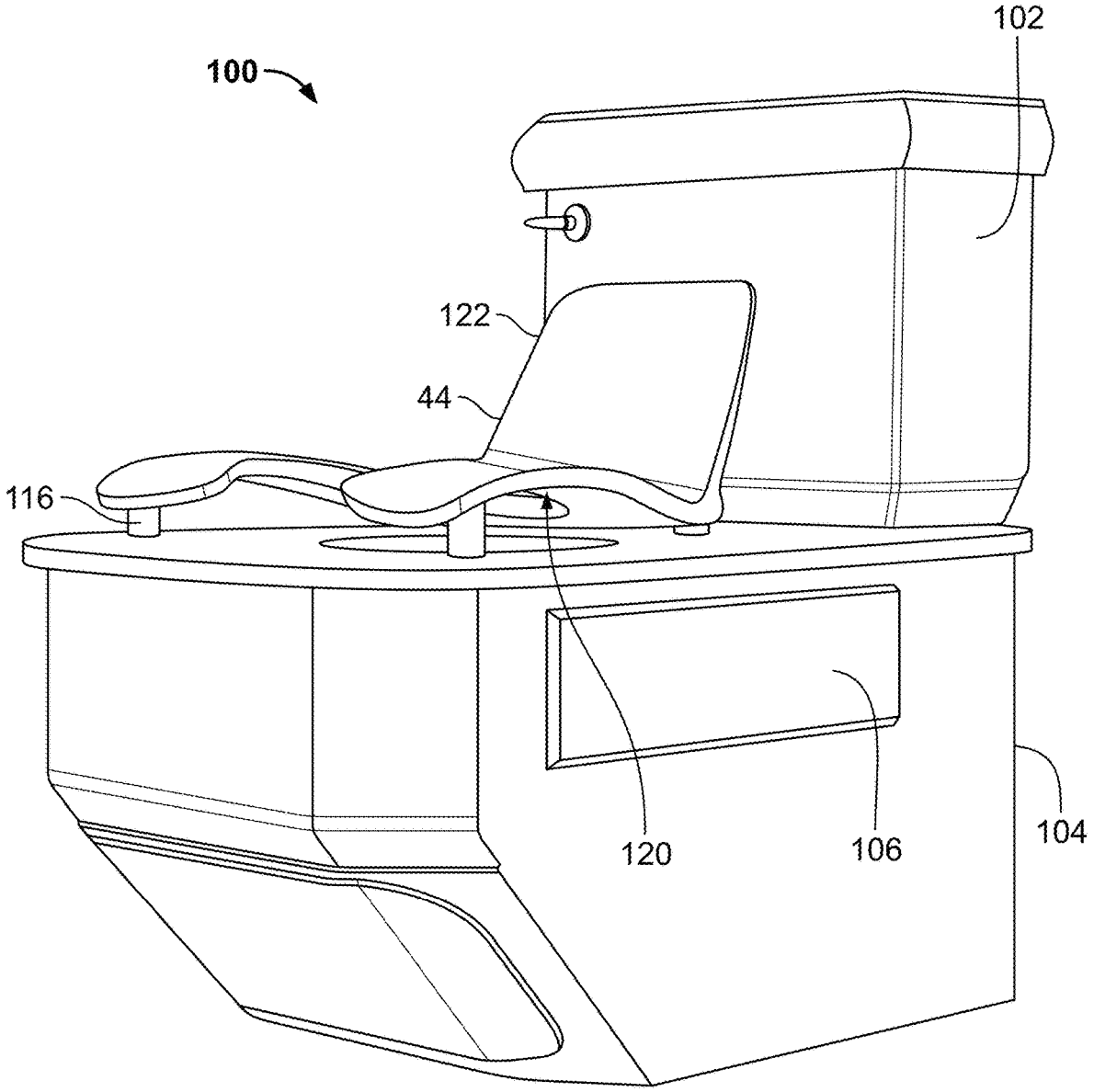
FIG. 6 shows a perspective view of aspects of the system.

Referring to FIG. 6, a system 100 is shown which can include tank 102 or can be disposed under an existing tank when a tank is not present in the system. An arm rest cover 106 can be carried by the base and received into the base. The arm rest cover can be a drawer slidably attached to the base. Seat 44 can include a seat back 122. The seat can include a seat convex surface 120 to better ergonomically fit a user. The seat can transition between an assist position (FIG. 7) and an operational position. In the operational position, the user is in the seated position. In the assist position, the user can transition from a standing position to a sitting position and the seat can be supported during the transition. In one embodiment, a lid can be disposed over the seat and pivotably connected to the base to cover the seat. A lid sensor can be included so that when a user is in proximity to the lid, the lid can be automatically opened such as with one or the motors in the motor set.

Figure 7:
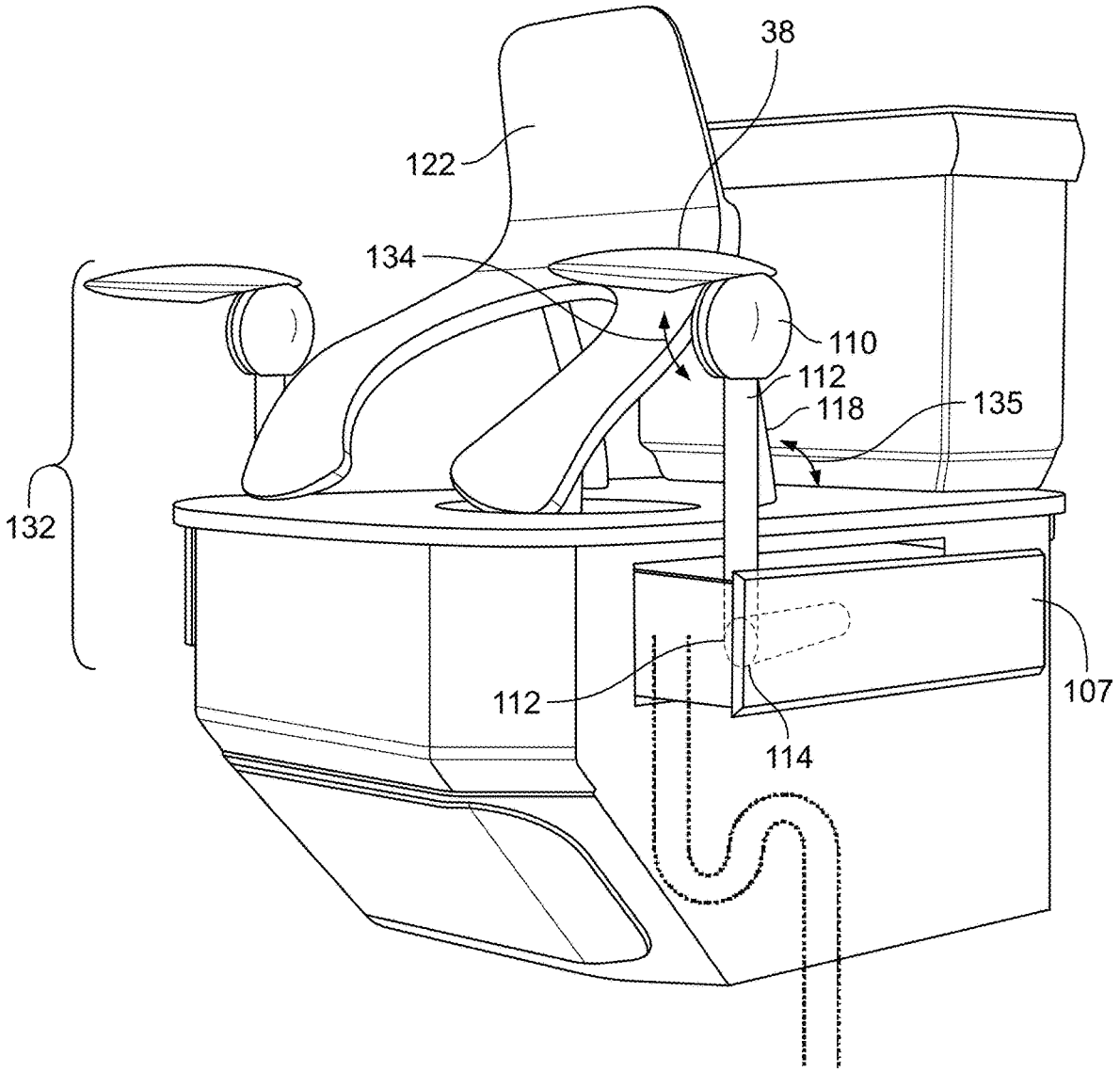
FIG. 7 shows a perspective view of aspects of the system.

Referring to FIG. 7, the assist position can also include an arm rest assembly 132 being extended from the base. The arm rest can assist the user in the transition from the standing position to the seated position. The arm rest assembly can include an arm rest 38 and arm rest arm rest extension 112 and arm rest upper pivot 110 connecting the arm rest to the arm rest extension. An arm rest lower pivot 114 can be connected to the arm rest extension and carried by the base. The arm rest assembly allows the arm rest to move in a direction generally shows as 134 and the arm extension to move in a direction generally shown as 135 so that the arm rest assembly can transition between a retracted position and an operational position. In the retraced position, the arm rest assembly can be received in an arm rest drawer 107 which can be received into the base. The bowl can be in fluid communications with a drain that can deliver fluid and waste to a sewer or other disposal system.

The seat can include a rear seat extension 118 that can support the rear of the seat in the assist position. The rear seat extension can be hydraulic or otherwise biased upwards so that when the user transitions between the standing position and the seating position the rear seat extension cushions the downward motion of the user. The seat can also be supported by forward seat extensions 116 (FIG. 6) and pivot generally about the forward seat extension when transitioning between the assist position and the operational position.

Figure 8:
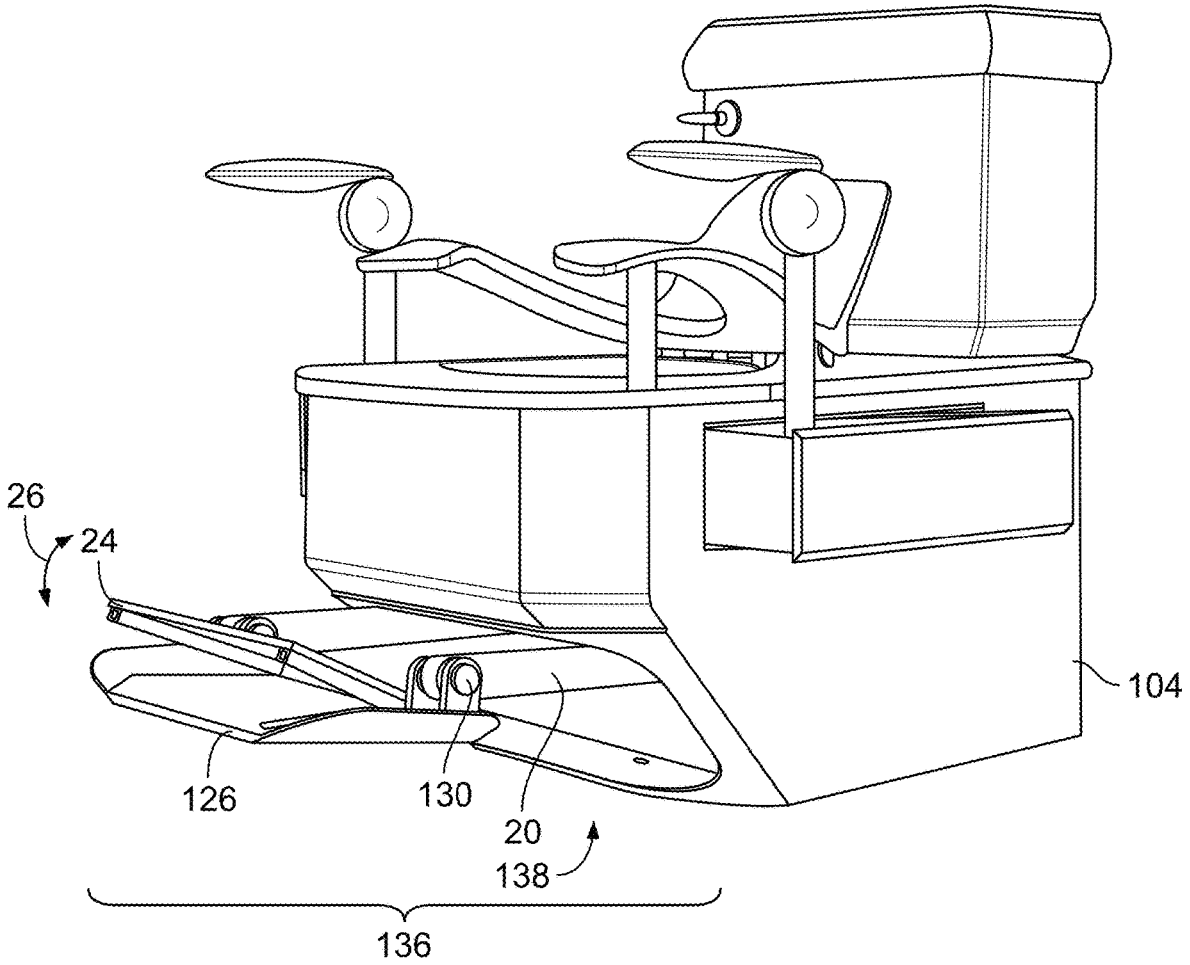
FIG. 8 shows a perspective view of aspects of the system.

Referring to FIG. 8, a footrest assembly is carried by the base 104. The footrest assembly can be received into the base in the retracted position (FIGS. 6 and 7). Once the user is seated, the footrest can be transitioned to the operational position where the footrest assembly extends from the base and can support the feet of the user. The footrest assembly can include a footrest 24 that can be carried by footrest extension or lateral leg extension 20. The footrest can be pivotally connected to the footrest extension with footrest extension pivot 130. The footrest cover 126 can be included in the footrest assembly so that when the footrest assembly is in the retracted position, the footrest assembly is received in the base and the footrest cover covers the footrest opening 138 defined in the base. The footrest can be pivotally connected to the footrest assembly so that the footrest can generally move in a direction shown as 26 to support the feet of the user. The footrest can include a proximity sensor so that when the user places a footrest on or near the footrest area, the footrest can be automatically deployed. The footrest can also be retracted when the user's foot is removed away from the footrest area.

The seat, arm rest assembly and footrest assembly can be mechanical so that the user manipulates the seat, arm rest assembly and footrest assembly to place the components in the various positions associated with the operational positions, assist position and the retracted position.

Figure 9A:
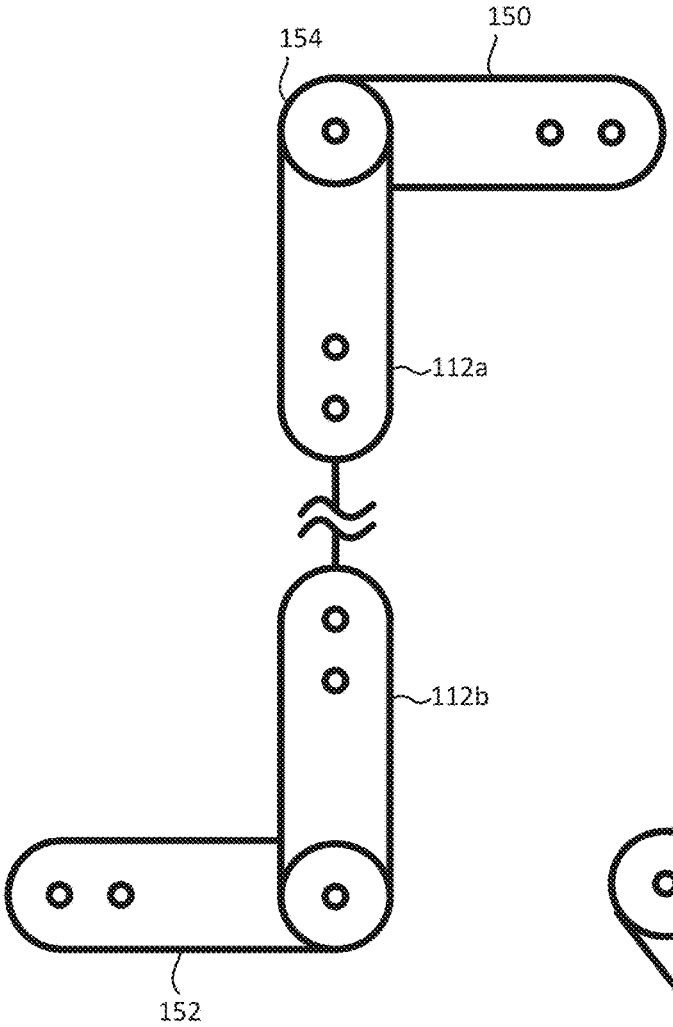
FIGS. 9A and 9B are side views of aspects of the system.
Figure 9B:
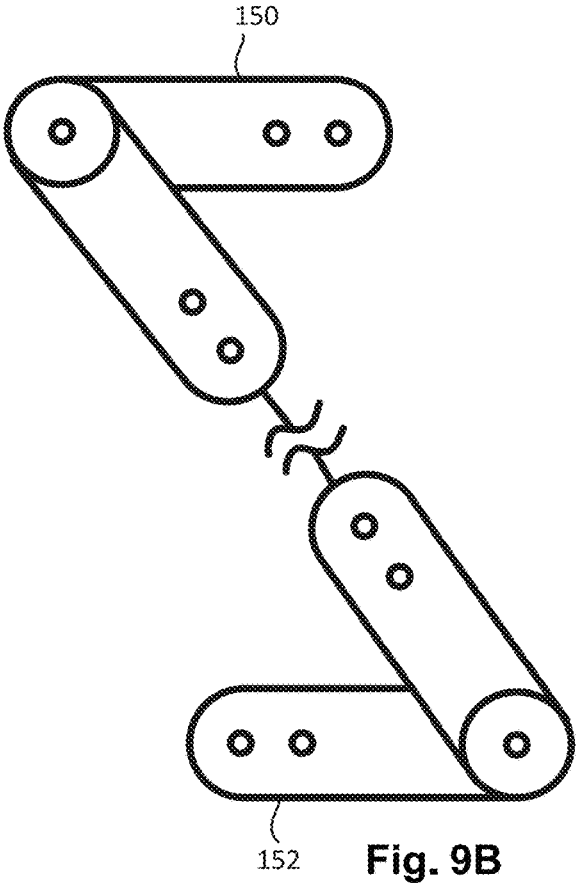

Referring to FIGS. 9A and 9B, an arm rest connection 150 can be pivotally attached to an upper arm rest extension 112*a*. An arm rest anchor 152 can be pivotally attached to a lower extension portion 112*b*. An upper gear assembly 154 can be included so that the upper extension and the arm rest connection pivot about each other when arm rest transitions between the retracted and operational position.

Figure 10:
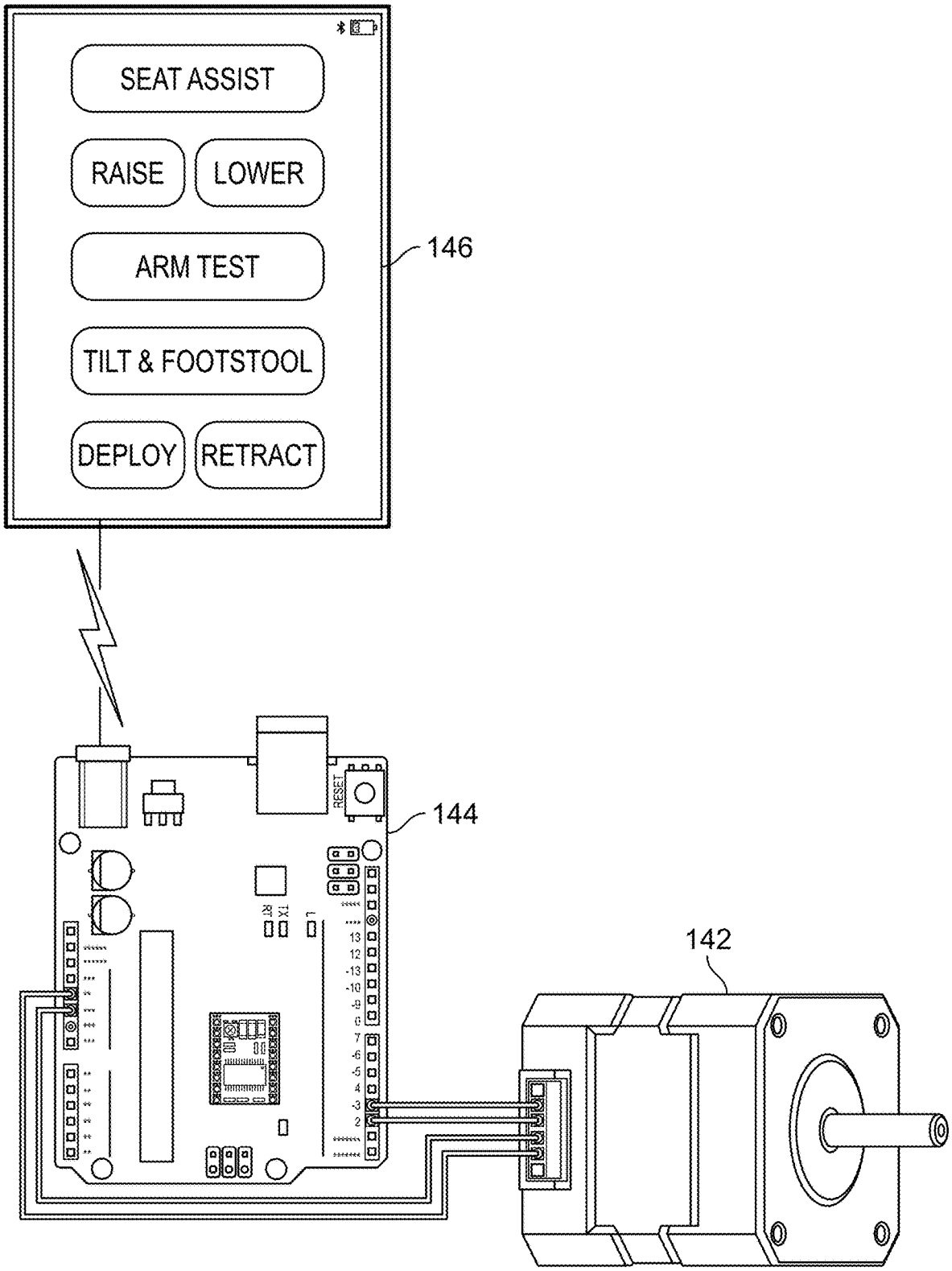
FIG. 10 is a schematic of the system.

Referring to FIG. 10, the seat assembly, arm rest assembly and footrest assembly can include a motorized actuator 142. These actuators can be included in a motor set that can include a motor operability associated with the rear seat extension to move the rear seat extension between the assist position and the operational position. A seat gear can be carried by the seat motor so that when the seat motor rotates the seat gear, the seat gear engages the rear seat extension, the rear seat extension is moved between the assist position and the operational position. A first arm rest motor can be included in the arm rest assembly so that when the first arm rest motor is actuated, the arm rest is rotated about the upper arm pivot and transitions between the retracted position and the extended position. A second arm rest motor can be included in the arm rest assembly so that when the second arm rest motor is actuated, the arm extension is rotated about the lower arm pivot and transitions between the retracted position and the extended position. A footrest motor can be included in the footrest assembly so that when the footrest motor is actuated, the footrest transitions between the retracted position and the extended position. The footrest extension can engage with a footrest gear carried by the footrest motor.

The motors of the motor set can be connected to a controller 144. The controller can be in wired or wireless communications with an input controller 146. The input controller can include computer readable medium, processor, power support, transceiver, and input and output ports. The input controller can transmit commands to the controller to transition the seat between the assist position and the operational position, raise the seat when it is in the operational position to adjust the height, transition the arm rest assembly from the retracted position to the operational position, tilt the footrest relative to a horizontal plane defined by the base, and extend/deploy and retract footrest.

The computer readable medium can include computer readable instructions that can receive input from the input controller and actuate the corresponding motor in the motor set according to the input received. The input controller can be an application disposed on a smart phone wherein the smart phone can be in wireless communications with the controller.

Figure 11:
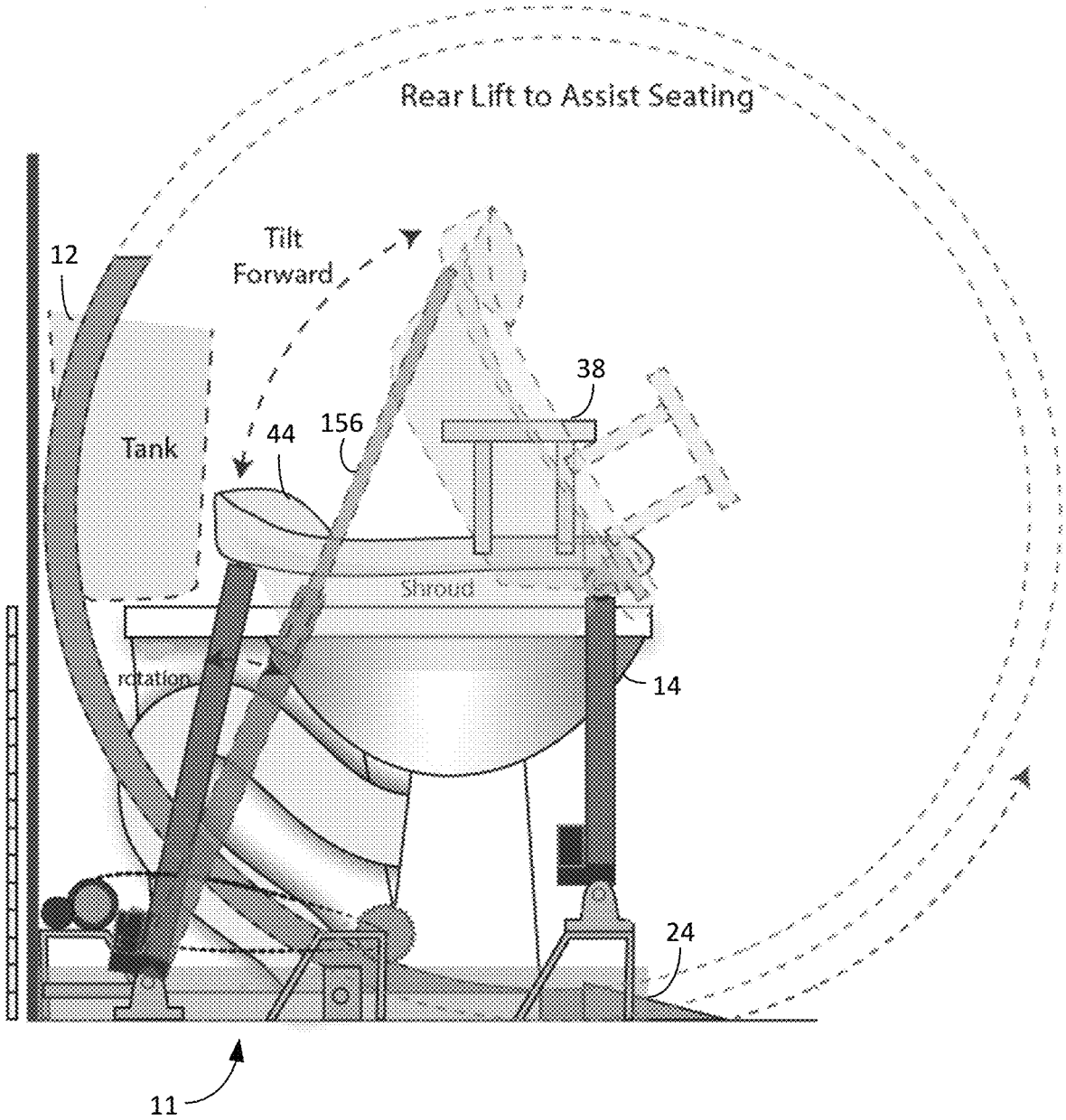
FIG. 11 is a side view of aspects of the system; and,
FIG. 12 is a side view of aspects of the system.

Referring to FIG. 11, tank 12 is shown positioned rear of the seat 44 and within a frame 11. The seat can be attached to a rear extension rod 156 which can be activated by the controller. The rear extension rod can be a telescoping assembly wherein a first rear rod segment received a second rear rod segment. When extended, the seat is transitioned from a generally horizontal position to a forward angled position configured to assist with an individual seating on the seat. As the seat extension rod extends, it can transition forward to a rear portion of the seat upwards and away from the tank to assist with an individual seating on the seat. A footrest 24 can be a retracted position so that the footrest is disposed under the bowl 14 so as not to obstruct the individual's positioning for sitting on the seat. In this retracted position, the footrest allows for the individual be positioned on the seat.

The armrests 38 can be attached to the seat so that they are transitioned form a generally horizontal position to aa forward angled position to assist the individual with sitting on the seat. Once the individual contacts the seat, when the seat is in the extended positions, the seat can be lowered.

Figure 12:
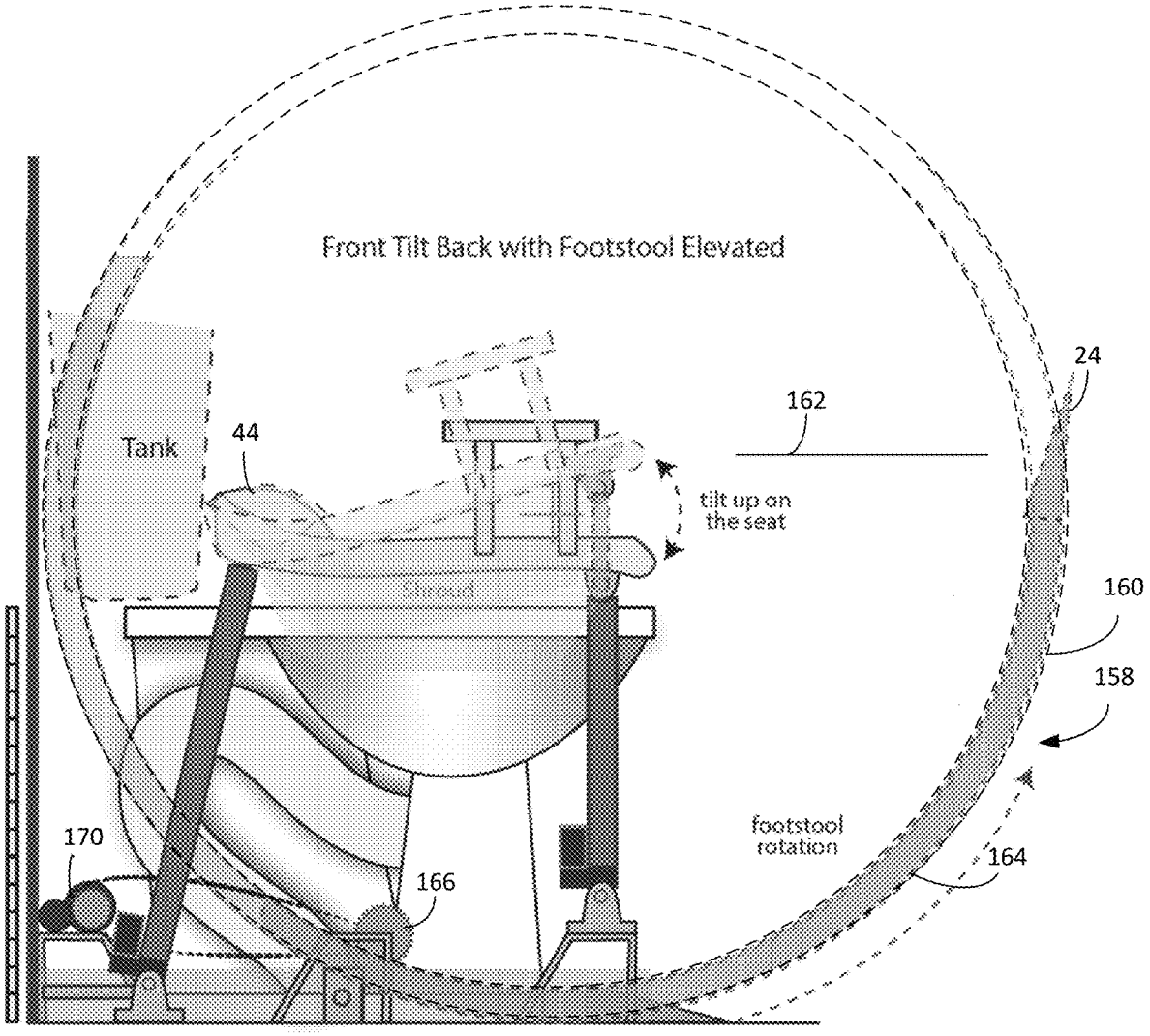

Referring to FIG. 12, the lowered position is show. The seat 44 can be placed in a rearward angled position where in the rear position of the seat is lower than the front portion of the seat. The front portion of the seat is tilted upwards and can raised between 5 and 25 degrees. In one embodiment, the front portion is raised between 12 and 18 fifteen degrees. In one embodiment, the front portion is raised 15 degrees. The front portion of the search can be raised using a front extension rod that cam be activated by the controller. The front extension rod can be a front telescoping assembly wherein a first front rod segment is received into a second front rod segment. When the seat transitions to the rearward angled position, a footrest assembly 158 can rotate along a path 160 so that the footrest 24 is transitioned into an extended position wherein the footrest 24 can be generally on the same horizontal plane 162 as the front portion of the seat. The footrest assembly can include the footrest 24 and a footrest arm 164. The footstool arm can include gear tracks that can engage gear 166 so that when the gear turns, the footrest arm can travel along path 168 raising the footrest 24. The gear can be connected to a motor 170 that can be connected to the controller to actuate the motor. The motor can be connected to the gear by belt, chain, cable or other connector.

The rest extension arm and the front extension arm can be pivotally connected to a frame so that when the seat transitions form a forward angled position to a horizontal position to a rearward angled position, the end of the rear and front extension arms can pivot allowing the seat movement. The footrest can transition from a first position to a second position which can be in the range of 50 degrees to 100 degrees along the travel path. In one embodiment, the path from the first position to the second position can be in the range of 60 degrees to 100. In one embodiment, the travel path is 85 degrees.

Unless specifically stated, terms and phrases used in this document, and variations thereof, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An advanced hygienic excreta system comprising:

a frame;

a seat attached to the frame and having a front angled position, horizontal position and rearward angled position so that a user's rectum is below a user's knees when the seat is in a rearward angled position;

a footrest assembly attached to the frame and having a footrest wherein the footrest is configured to be raised when the seat is in the rearward angled position;

a gear configured to engage with a footrest arm included in the footrest assembly to transition the footrest from a lowered position to a raised position;

an arm rest assembly attached to the seat;

wherein a rear portion of the seat is configured to extend upwards and forward from the frame to assist the user in transitioning from a standing position to a seated position; and, a front seat portion configured to be disposed generally horizontal to the seat in the horizontal position and raised above the rear portion of the seat in the rearward angled position.

2. The system of claim 1 including a controller carried by the frame and connected to a motor connected to the footrest assembly and configured to receive input from an input device and actuate the motor set to extend and retract the footrest.

3. The system of claim 2 wherein the controller is configured to actuate a rear extension rod to raise a rear portion of the seat.

4. The system of claim 2 wherein the controller is configured to actuate a front extension rod to raise the front seat portion.

5. The system of claim 2 wherein the controller is configured to actuate a rear extension rod to place the seat in a forward angled position and rotate a footrest arm included in the footrest assembly so that the footrest is in a lowered position.

6. The system of claim 2 wherein the controller is configured to actuate a front extension rod to place the seat in a rearward angled position and rotate a footrest arm included in the footrest assembly so that the footrest is in a raised position.

7. The system of claim 1 wherein the footrest assembly includes a footrest pivot configured to change an angle of the footrest relative to a horizontal plane.

8. The system of claim 1 including:

an arm rest motor subset included in a motor set and cooperative associated with the arm rest assembly to transition the arm rest assembly from an armrest retracted position to an armrest extended position;

a footrest motor subset included in the motor set and cooperative associated with the footrest assembly to transition the footrest assembly from a footrest retracted position to a footrest extended position; and, a seat motor subset included in the motor set and cooperative associated with the seat to transition the seat from the front angled position to the rearward angled position.

9. The system of claim 8 wherein the gear is configured to transition the footrest from a lowered position to a raised position contemporaneously with the seat transitioning from forward angled position to a rearward angled position.

10. An advanced hygienic excreta system comprising:

a frame;

a seat attached to the frame having a forward angled position and a rearward angled position;

a rear extension rod attached between the rear portion of the seat and the frame and a front extension rod attached between the front portion of the seat and the frame;

a footrest attached to the frame configured to transition from a lower position to a raised position contemporaneously with the seat transitioning from the forward angled position to the rearward angled position;

wherein a front portion of the seat is positioned above a rear portion of the seat relative to a horizontal plane when in the rearward angled position.

11. The system of claim 10 including an arm rest attached to the seat.

12. The system of claim 10 wherein the rear portion of the seat is configured to extend upward and forward from the frame to assist a user in transitioning from a standing position to a seated position.

13. The system of claim 10 including a controller connected to a motor set carried by the frame and connected to a rear extension rod connected between the frame and the rear portion of the seat and a front extension rod connected between the frame and a front portion of the seat.

14. The system of claim 13 wherein the controller is connected to a motor configured to actuate a gear configured to raise the footrest from the lowered position to the raised position.

15. An advanced hygienic excreta system comprising:

a frame;

a seat connected to the frame with a rear extension rod and a front extension rod;

wherein a rear portion of the seat is configured to transition upward and forward relative to a horizontal position and rearward and downward relative to the horizontal position to assist a user in transitioning between a standing position and a seated position; and, a footrest assembly attached to the frame configured to transition from a lowered position to a raised position contemporaneously with the seat transitioning from a forward angled position to a rearward angled position.

16. The system of claim 15 including: a motor set operationally associated with the seat to transition the seat upward and forward relative to the frame and rearward and downward relative to the frame.

17. The system of claim 15 including:

a footrest included in the footrest assemble wherein the footrest is carried by the frame to support a user's feet when the user is in a seated position; and, an arm rest attached to the seat and configured to extend away from the frame to support a user's arm when the user is transitioning from the standing position to the seated position.

18. The system of claim 17 including a controller carried by the frame and connected to a motor set connected to the seat and footrest assembly and configured to receive input from an input device and actuate the motor set to extend and retract the seat and footrest.

* * * * *